US008453579B2

(12) United States Patent
Nemeth

(10) Patent No.: US 8,453,579 B2
(45) Date of Patent: Jun. 4, 2013

(54) WATER RIDE WITH IMPROVED BOAT CAPTURE MECHANISM

(75) Inventor: Edward A. Nemeth, Hermosa Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 234 days.

(21) Appl. No.: 13/112,095

(22) Filed: May 20, 2011

(65) Prior Publication Data

US 2012/0291657 A1 Nov. 22, 2012

(51) Int. Cl.
*A63G 3/00* (2006.01)

(52) U.S. Cl.
USPC ..... 104/53; 104/73

(58) Field of Classification Search
USPC ..... 104/69, 70, 71, 72, 73, 139, 140, 104/145, 146, 53, 59; 238/10 E, 10 F
See application file for complete search history.

(56) References Cited

U.S. PATENT DOCUMENTS

| | | | | |
|---|---|---|---|---|
| 717,457 | A | 12/1902 | Schofield | |
| 1,357,995 | A | 11/1920 | Kitterman | |
| 3,113,528 | A * | 12/1963 | Morgan et al. | 104/73 |
| 3,404,635 | A | 10/1968 | Bacon | |
| 3,930,450 | A * | 1/1976 | Symons | 104/73 |
| 4,337,704 | A | 7/1982 | Becker et al. | |
| 5,473,990 | A | 12/1995 | Anderson et al. | |
| 5,732,635 | A * | 3/1998 | McKoy | 104/73 |
| 7,437,998 | B2 | 10/2008 | Burger et al. | |
| 7,484,460 | B2 | 2/2009 | Blum et al. | |
| 2006/0219124 | A1 | 10/2006 | Jordan | |

* cited by examiner

*Primary Examiner* — Mark Le
(74) *Attorney, Agent, or Firm* — Marsh Fischmann & Breyfogle, LLP; Kent A. Lembke

(57) ABSTRACT

A boat capture assembly that enhances control over boats moved by a track assembly through a body of water. The capture assembly includes a mounting plate attached to a positionable portion of the track assembly (such as to a bogie). The capture assembly includes a rigid extension arm with a first end attached to the mounting plate and a pivot structure, defining a pivot surface, rigidly attached to a second end of the rigid extension arm. The capture assembly includes a receiver cavity provided in a bottom surface of a hull of a boat. The receiver cavity includes a sidewall or body with an opening receiving the pivot structure, with the sidewall defining a well or recessed surface with a cross sectional shape and size to receive and allow vertical movement of the pivot structure but to restrain fore and aft movement of the hull relative to the pivot structure.

17 Claims, 6 Drawing Sheets

DEPTH = 0
PITCH = 0

DEPTH = 0
PITCH = -5 DEG

DEPTH = -12"
PITCH = 0

DEPTH = -12"
PITCH = -5 DEG

DEPTH = -12"
PITCH = +5 DEG

WATER RIDE WITH IMPROVED BOAT CAPTURE MECHANISM

BACKGROUND

1. Field of the Description

The present invention relates, in general, to water or boat-based amusement park rides, and, more particularly, to a water ride with a boat capture assembly for tethering or linking a floating vehicle or boat to a track system that is used to move the boat in a body of water in a controlled manner that simulates a conventional boat's movement through the water (e.g., with expected roll, pitch, and yaw as well as up and down movements).

2. Relevant Background

Amusement parks continue to be popular worldwide with hundreds of millions of people visiting the parks each year. In many parks, boat or water rides with floating vehicles are popular with park visitors, especially during hotter seasons. Boat (which may be any type of floating vehicle) rides are typically designed to simulate movement of a floating boat such as a drifting raft or motorized craft. While some rides allow unexpected or almost random movement and location of the boats along a waterway, many water-based rides are configured with show or entertainment features that require better or tighter control of the boat positions. Such control may include an ability to accelerate and decelerate the boat in a predictable manner. The ride designer, though, is also expected to maintain the "feel" of a floating boat throughout the experience including heave, roll, pitch, and yaw movements in response to shifting rider weights or movement of the water.

A common boat ride may include boats that each have guide wheels provided on sides of the boat, e.g., out of sight below the level of the water, to contact sides of a water channel or trough. Additionally, wheels may be provided on the bottoms of the boats to protect the boat against bottoming out in the trough. Each boat is moved forward along the length of the trough by propelling a volume of water down the trough in the desired direction of travel. The trough may be sloped to provide a gravity flow of the water and/or pumps may be provided to move water in flat or less sloped portions of the trough.

Use of flowing water is a proven and simple type of propulsion, but a number of limitations with boat rides have hampered creation of new designs and integration of complex, synchronized show elements within these boat rides. First, the boats are typically limited in their travel such that they only face forward or randomly twirl around in some river raft rides. This characteristic of boat rides creates limitations on controlling passenger sight lines, which can make it difficult to effectively present show elements to the passengers in comparison to dry ride systems where a vehicle can be controlled to face in any direction along a track.

Second, the boats may each travel at differing speeds such as varying within the range of 2 to 4 feet per second. This wide variance in speed may be caused by the boats being loaded differently such as with differing numbers and sizes of passengers. The varying loads results in heavier boats traveling faster than the more lightly loaded boats as the water flow rate varies within a channel (e.g., is faster at a particular depth that may not be reached (or to a lesser amount) by lighter boats). This creates unequal spacing of the boats (e.g., varying boat-to-boat spacing) as the faster boats catch up with the slower boats or leave the slower boats far behind. In high capacity rides, boats are dispatched relatively close together, and the natural variation in boat speeds causes the boats to clump together or spread apart, both results typically being undesired by the ride operators. Testing has shown that equally loaded boats may experience speed variances of up to 3 percent while unequally loaded boats may experience speed variances of up to 9 percent. Boat rides with unpredictable and varying boat speeds (and, hence, unknown positions) have blocked such attractions from having timed or triggered individual show scenes.

Boat rides can be designed to account for varying speed, but these rides have limited appeal to many amusement park operators. For example, varying boat speeds may be accounted for by providing an elaborate and complex method of sorting boats based on their loading (and, hence, expected travel speeds in the flowing water in the trough) upstream of a show scene portion of a ride. Positive methods for sorting boats are typically mechanical, but these mechanical sorting arrangements tend to undesirably interrupt the "free floating" feel and pace of the boat ride.

In some boat rides, a moving cable is provided within the trough, and each boat is tethered to the cable so that it is propelled by being pulled along with the cable instead of by moving water. Such towing cable rides are useful in some applications such as rides limited to a single boat speed, to flat or non-sloped configurations (e.g., to avoid boat collisions on sloped portions), and to a forward-facing boat orientation (i.e., a single passenger sight line) in other cases, a track structure is provided in the water under the boat, and a vehicle or bogie on this track is used to pull or push the boat along the track. The boat is typically linked to or tethered to the track-based vehicle with a relatively complex mechanical linkage, which may be expensive to design and manufacture and may require extensive or regular maintenance or even fail during ride operations.

Hence, there remains a need for improved boat rides for use in amusement parks. Preferably, a boat ride system can be designed that provides adequate control over the speed, position, and, in some cases, orientation of each boat along the ride's travel path while providing a passenger carrying compartment that otherwise behaves or moves similar to a conventional floating craft.

SUMMARY

To address the above and other needs, the present description describes a boat ride that includes a unique boat capture assembly. The capture assembly provides a very simple and reliable coupling between a constrained track element and a floating rider compartment (e.g., a "boat") such that certain motions of the rider compartment (e.g., movement along the track, lateral displacement, and, sometimes, the heading of the rider compartment) are well defined and can be absolutely set by the ride designer, while other motions (e.g., heave, roll, pitch, and, sometimes, heading) are free to move in response to rider or water movements in a boat-like fashion.

Briefly, the boat ride includes a floating structure such as a passenger boat that may float above a track structure or assembly within a body of water. The boat ride then includes a capture assembly made up of a floating portion and a guide element portion. The floating portion may include one or two receiver cavities or wells provided in the bottom surface of the boat hull (e.g., a cylindrical channel or tunnel extending a distance such 1 to 2 feet or more into the hull).

The guide element portion includes a mounting plate or connector fixed to a bogie or other positionable component of the track assembly (e.g., the mounting plate moves selectively along a track with a bogie/vehicle). The guide element portion further includes one or two pivot or extension arms that may be rigid rods/members extending out from the mounting plate. The guide element portion also provides a pivot structure (or head/end) attached to the second or outer ends of the extension arms. These heads/ends may be spheres, be semi-spherical or disc shaped, or be cylindrical, or another shape, and the heads are received within the receiver cavities to "capture" the boats and also to provide a pivot/contact surface(s) between the guide element portion and the floating portion.

During use, the hull may move up and down freely and typically can also move freely with yaw, roll, and pitch. To keep the hull captured, the head/pivot structure typically extends upward into the well/cavity a distance that is greater than a maximum anticipated vertical excursion (e.g., more than an expected up/down bobbing of the boat in the water during the ride). The movement of the bogie/tracked vehicle is effectively passed to the hull via the rigid extension arm, and the head/pivot structure typically will be tightly received within the well/cavity along the longitudinal axis so as to constrain fore/aft and left/right motion of the hull relative to the pivot point. For example, the head/pivot structure may be a sphere and the well/cavity may take on a cylindrical shape with an inner diameter that is only slightly larger than the outer diameter of the head/pivot structure (e.g., a clearance of 0.1 inch or less in some cases).

More particularly, a boat capture assembly is provided that enhances control over boats moved by a track assembly through a body of water. The capture assembly includes a mounting plate attached to a positionable portion of the track assembly (such as a bogie that rolls on a fixed track that is submerged in a water containment such as a channel or pool). The capture assembly also includes a rigid extension arm with a first end attached to the mounting plate. Further, the capture assembly includes a pivot structure, defining a pivot surface, rigidly attached to a second end of the rigid extension arm. The capture assembly also includes a receiver cavity provided in a bottom surface of a hull of one of the boats. The receiver cavity may include a sidewall with an opening receiving the pivot structure, with the opening defining a well or recessed surface with a cross sectional size greater than an external size of the pivot structure.

In some embodiments, the well has a depth greater than a predefined vertical travel of the hull of the boat in the body of water such as a depth greater than about 2 feet, and the pivot structure extends at least this predefined vertical travel distance into the well (e.g., the well may be 4 feet deep and the head/pivot structure may extend about 2 feet into the well during initial assembly/boat capture). In some embodiments of the capture assembly, the well has a circular cross sectional shape with an inner diameter exceeding an outer diameter of the pivot structure. Specifically, in some cases, the inner diameter is less than 0.1 inch greater than the outer diameter to give clearance for up/down movement but to restrain fore/aft and/or left/right movement of the hull relative to the pivot point.

In other cases, the well has a rectangular cross sectional shape, and the pivot structure has a cylindrical body. In these embodiments, the well may have a longer axis transverse to the longitudinal axis of the hull. In some exemplary embodiments of the capture assembly, the well has an elongate cross sectional shape with a short axis transverse to the longitudinal axis of the hull. In these embodiments, the external size of the pivot structure is about equal to a width of the well measured along the short axis, whereby left to right movement of the hull is restrained.

In a dual-pivot embodiment, the capture assembly may include: (a) a second rigid extension arm with a first end attached to the mounting plate at a location spaced apart from the rigid extension arm; (b) a second pivot structure, defining a pivot surface, rigidly attached to a second end of the second rigid extension arm; and (c) a second receiver cavity provided in the bottom surface of the hull. The receiver cavity may include a sidewall with an opening receiving the pivot structure and the opening defining a well with a cross sectional size greater than an external size of the second pivot structure.

DETAILED DESCRIPTION

Figure 1:
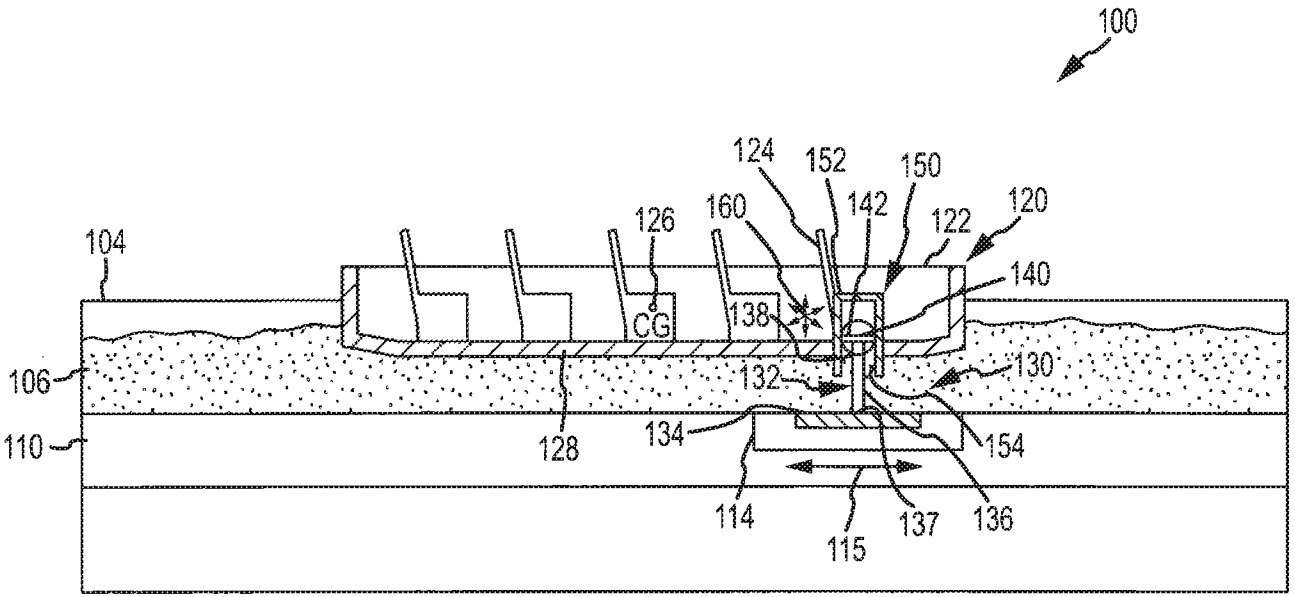
FIG. 1 is a partial side sectional (and functional block) view of a boat ride or boat ride system illustrating use of a capture assembly of the present invention to propel a boat (i.e., any floating object or vehicle) in a waterway or trough filled with water in a controlled manner; note, circles are provide about each pivot structures/heads to generally indicate that these each may be a sphere or a portion/section of a sphere)

Briefly, embodiments of boat rides or ride systems described herein make use of unique capture assemblies to control acceleration or deceleration of a floating vehicle/object ("boat"). Briefly, the capture assemblies include a base or mounting element that is affixed to or linked to a bogie or vehicle that rides in or on a track of a track assembly or structure, and the bogie/vehicle provides the motive force for positioning the boat in a body of water. The capture assemblies also include at least one receiver cavity or well in a bottom surface of the boat hull or body. The capture assemblies further include a pivot or extension arm (e.g., a rigid rod or the like) extending out a distance from the mounting element (and the bogie). At the end of the rigid pivot arm, a head or pivot structure is provided, and the head or end of the pivot arm is positioned within or received within the receiver cavity.

The depth of the receiver cavity defines an amount of up and down movement of the boat as the boat may "bob" in the water without escaping from the capture or pivot arm (e.g., the head or end of the arm extends upward into the cavity/well a predefined minimum distance to remain in the cavity throughout the ride). The shape and size of the cavity/well (or an interior surface defined by its sidewall(s)) combined with the shape and size of the head or pivot structure received in the cavity/well limit movement in some directions (such as fore/aft and left/right) while allowing free movement in other directions (such as up/down, roll, pitch, and yaw). In some embodiments (such as with a boat with a circular hull), a single pivot arm may be used to capture a boat as it is moved along a track. Other embodiments may utilize dual, spaced-apart pivot arms (one forward and one aft) so as to limit side movements of the boat hull along the full length of the boat as a single pivot aim may allow one or both ends of the hull to move side-to-side, which may be undesirable in some cases (but readily accepted in others in which a single pivot arm may be used as described below such as with reference to FIG. 1).

Generally, several differing geometries may be used to practice the boat capture techniques of the present invention. However, before turning to the figures and particular configurations, it may be useful to provide an overview of how the boat capture may be implemented. The capture assembly concept only requires a guide element and a floating element. The guide element is rigidly linked to a track assembly, through a bogie/vehicle traveling or positionable on a track, that is placed under water in a water containment (e.g., a pond/pool, a water channel, and the like). For example, an extension arm may be affixed at one end (e.g., via a guide or base member) to a bogie riding on a track. In this way, the only motion of the guide element is along the track, and the guide element cannot move up/down, left/right or with roll, pitch, or yaw relative to the fixed track structure.

In the guide element or assembly, extending up from the bogie (or a base attached to the bogie) and track structure, the guide element includes a vertical support or extension arm. At the end opposite the track structure, a head or tip is provided that may take a number of shapes and sizes but acts to define a pivot or contact surface for the guide element with a captured boat hull. For example, the head or tip may be a planar disc, may be cylindrical in shape, or may be a full or partial sphere (e.g., the guide element would appear similar to many lollipops). Typically, there are no moving or flexible components provided in the guide element making it simple to manufacture and also making it very reliable with little or no maintenance being required compared to other mechanisms.

The floating element (e.g., the boat) includes a receiver cavity or well extending into its body (or hull) such as from a bottom surface contacting the water. In some embodiments, the floating element includes a cylindrical cavity that is open at the bottom and extends upward into the body of the floating element. When the floating element is "captured" by the guide element, the head or tip of the guide element is received within this cylindrical cavity. The cylindrical cavity may have an inner diameter that is nominally the same as the outer diameter of the spherical head on the end of the extension or pivot arm of the guide element/structure for slightly larger such as with less than an inch of clearance).

In other words, the floating element or boat is attached to the guide element by positioning the two parts of the ride or capture assembly such that the spherical section on the guide structure is captured within the cylindrical cavity on the bottom of the floating element. When attached or captured, the floating element cannot move fore or aft or left to right relative to the guide element (except for an amount equal to the clearance). The motion is constrained by contact between the spherical section or head's contact/pivot surface and the inner surfaces of the sidewall providing the cavity on the floating element. However, significantly, the floating element is free to move up or down (vertical movement) and is also free to roll, pitch, and yaw relative to the head of the guide element.

The capture assembly is adapted such that the unconstrained degrees of freedom produce the boat "feel" while the constrained degrees of freedom provide direct control over the floating element or boat. The floating vehicle or boat can be "locked" into position by allowing the floating element to come down onto stops provided on the base or mounting element of the guide element or assembly such as by decreasing the distance between the track and the surface of the water, which may be useful for loading and unloading the boat (e.g., station operations) or for providing a varied ride or show experience (a portion with a dry land vehicle-type ride versus a floating boat ride experience). The capture concept supports an amphibious-type experience where the track alternatively runs over land while the hull/body rests on stops to fully capture the hull/body causing the vehicle to behave like a land-based vehicle, and sections where the track descends below water allowing the hull/body to float off the stops/wheels in a water section causing the vehicle to behave like a boat (where the track is used to provide motive force/positioning that may include controlled acceleration and deceleration).

Figure 2:
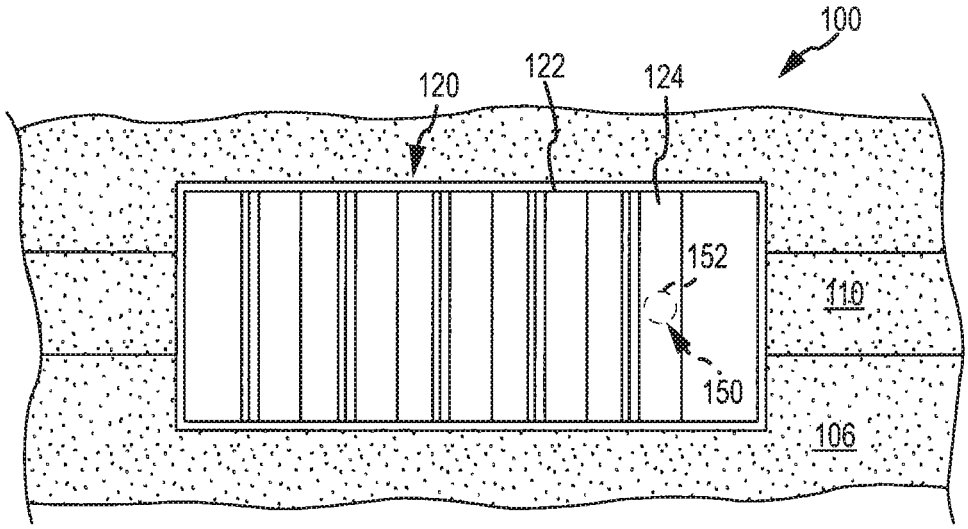
FIG. 2 illustrates a top view of the boat ride system of FIG. 1.

FIG. 1 illustrates a partial sectional view of a boat ride or water ride system 100 of one embodiment of the invention while FIG. 2 shows a top view of the same system 100. As shown, the system 100 may be considered a single pivot embodiment of the boat capture concept described herein. The single pivot embodiment in system 100 constrains fore and aft motion and left and right motion of pivot point and a boat pivotally connected to a capture assembly at that pivot point. This allows free movement of the "captured" boat in the following directions/types of movement: (a) up and down movement (float up and sink down in the water like a conventional boat); (b) roll; (c) pitch; and (d) yaw. As discussed below, the pivot "point" may be provided in some preferred (but not limiting) examples by a fixed spherical section captured or received within a cylindrical receiver cavity or a well within a bottom surface of a floating structure or boat.

More particularly, the boat ride 100 includes a containment structure 104 such as walls and a base/floor defining a channel/waterway, a pond/pool, or a basin. The containment structure 104 receives or is filled with a volume of water (herein, "water" is intended to include any liquid or water-additive mixture that is used to float objects or vehicles in a ride) 106. Note, a containment structure 104 is shown as a manmade-type structure, but the concepts taught herein are applicable to natural containment structures such as lakes, rivers, and even bays or other portions of larger bodies of water such as a sea or the ocean. One useful feature of the capturing techniques is that they are not limited to use within a channel as is the case with many prior boat capture mechanisms.

Under a level or surface of the water 106, a track assembly or structure 110 is mounted or placed. The track assembly 110 may take a variety of forms to practice the boat ride 100, and it is adapted to provide a guided and controlled movement of a boat 120. This may be achieved with a bogie or vehicle 114 riding on a fixed track (not shown) through the water 106, but many other configurations may be utilized in ride 100. The bogie/vehicle 114 may move in either direction along the track structure 110 as shown by arrow 115, and its movements provide acceleration and deceleration for the boat 120. Movement of the bogie/vehicle 114 can be used to tightly control a position of the boat 120 within the boat ride 100, which may be desired for synchronizing show elements to the position and movement of the boat 120 in an improved manner when compared to free-floating boats tethered to flexible cables or pushed along by volumes of water in a channel.

The boat ride 100 further includes a structure/element or boat 120 floating on water 106 above the track 110. The boat 120 is shown to be a conventional, rectangular boat that may be used in a water ride but other configurations may be used such as a circular configuration popular in many raft-type rides. The boat 120 includes a body or hull 122 in which a number of benches or seats 124 are provided on a top or upper surface. The hull 122 further includes a lower or bottom surface 128 (surface or wall facing toward the track assembly 110) that contacts the water 106 and upon which the boat "floats." The boat 120 may have a center point or center of gravity (floatation) 126, which in this case is about the center of the hull 122 passing through a center seat/bench 124 located about half way between the forward and aft ends of the hull 122.

Significantly, the boat ride 100 further includes a capture assembly 130 that is configured to allow the boat 120 to have free movement (i.e., up/down, roll, pitch, and yaw) while providing controlled movement of the boat 120 (i.e., constrain fore/aft motion and left/right motion of a pivotal connection point between the boat 120 and the bogie 114 and track structure 110). The capture assembly 130 includes a guide element 132 with a base or mounting plate/member 134 that is rigidly affixed to the bogie 114 such that the capture assembly 130 moves 115 with the bogie 114 in the track structure 110.

Further, the capture assembly (or guide element) 130 includes an extension or pivot arm 136 that is mounted in a rigid or fixed manner at a first end 137 to the mounting plate 134 and, therefore, bogie 114. The extension arm 136 generally is an elongated member such as a rod or bar with a circular, rectangular, or other geometrical cross section shape (e.g., a metal rod or bar of adequate size configuration to have enough strength to capture the boat 120 during operation of the ride 100). The arm 136 extends out a length or distance that allows the bottom 128 of the hull 122 to be separated a distance from the track 110 and bogie 114 and also allows up and down (bobbing) movement of the captured hull 122.

The capture assembly 130 further includes a receiver cavity or well 150 provided in or on the bottom surface 128 of the hull 122 of the boat 120. The cavity 150 may be provided at nearly any point along the length of the hull 122 and surface 128 with the cavity 150 being shown to be fore of the center of gravity 126 in this case. Typically, such forward positioning may be useful if this end of the boat 120 is pulled by the aim 136 as the bogie 114 moves 115 along the track structure 110 (e.g., to the right in the drawing of FIG. 1). The receiver cavity 150 is formed in this case with a sidewall or hollow body 152 with an opening 154 exposed at the bottom surface 128 (open to the track structure 110). The sidewall 152 may be configured as shown to have a circular cross section of a single or uniform inner diameter. The receiver cavity 150 and its opening 154 define a cavity or well with a particular depth (e.g., 1 to 3 feet or more for most boats but less for smaller objects that do not move up/down as much).

The capture assembly 130 further includes a pivot structure or head/end 140 mounted in a rigid manner (or provided as a uniform portion of arm 136) on a second end 138 of the extension arm 136. The head 140 is typically bulbous or with a larger size (e.g., diameter) than the arm 136. The head 140 defines one or more pivot or contact surfaces 142 that may abut or contact the inner surfaces of the body 152 via opening/hole 154 in receiver cavity 150. In some embodiments, the head 140 is a circular disk while in some cases the head 140 is a full or partial spherical structure (e.g., a sphere or hemisphere or the like). The outer diameter of such a disk or spherical structure 140 typically will be selected to be a small amount less than the inner diameter of cavity/well 154 in body 152. For example, very little clearance (such as less than 0.1 inch) may be useful to allow the boat hull 122 to move up and down while providing tight restraint over fore/aft and left/right movements.

During operations, the hull 122 is captured by the capture assembly 130 by positioning the boat 120 over the track structure 110 in the water 106. The pivot arm 136 and head/pivot structure 140 are received within the cavity 150 such that head 140 extends upward a minimum distance from the opening/end 154 of the body/sidewall 152 (e.g., a minimum engagement length that is greater than a maximum anticipated up/down movement of the hull 122 in the water 106 during ride operations such as 1 to 2 feet or the like). The depth of the well/cavity 150 typically will be at least about twice such a maximum expected vertical travel/bobbing to avoid the head 140 contacting the upper end/wall 152 in the cavity 154, but, in some cases, such contact is desired for a particular effect and an elastic stop/bumper may be provided on the upper, inner surface of the body/sidewall 152 to reduce/control shock forces.

When the bogie moves forward (or backward) 115 in the track structure 110, the head 140 contacts the inner surfaces of the body/sidewall 152 in the cavity/opening 154 causing the hull 122 to move with the bogie 114 in a one-to-one manner. However, during such movement 115, the hull 122 may move up and down or bob on the water 106 as the hull 122 is not captured in the vertical direction by the capture assembly 130 (e.g., the receiver cavity 150 may move vertically, as shown with arrows 160, relative to the pivot arm 136 and head/pivot structure 140). Further, the hull 122 is relatively unconstrained to have roll, pitch, and yaw movements, as shown again with arrows 160, because the inner surfaces opening/cavity 154 can pivot on contact/pivot surfaces 142 of the head/pivot structure 140 positioned within the receiver cavity structure 150.

Figure 3:
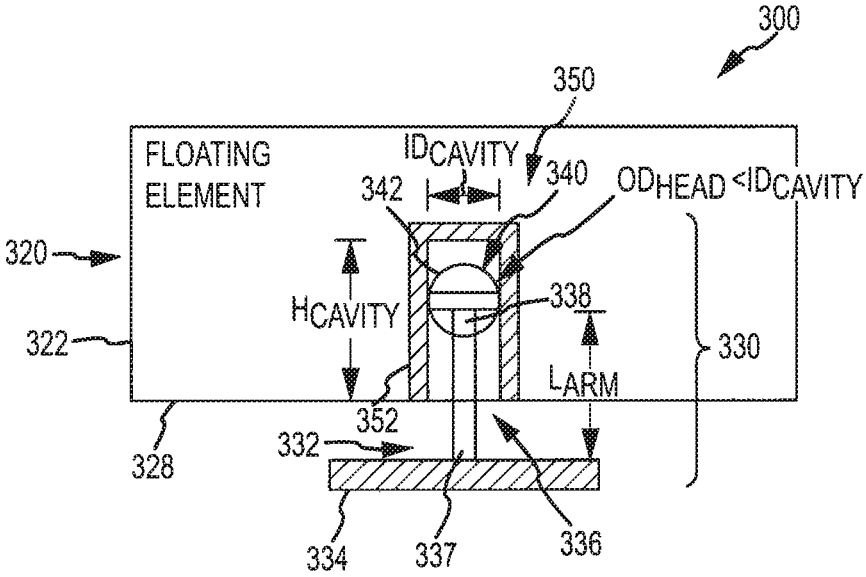
FIG. 3 is a sectional view of a portion of boat ride system similar to that of FIG. 1 showing an exemplary capture assembly in more detail.

FIG. 3 illustrates a portion of a ride system 300 that is simplified in some ways to provide more detail of an exemplary capture assembly. As shown, the ride system 300 includes a floating element 320 and a capture assembly 330. The floating element 320 (e.g., any floating object such as a circular boat or the like) includes a buoyant body 322 with a bottom surface 328 adapted for contacting and floating on a body of water (not shown in FIG. 3).

The capture assembly 330 provides a pivotal linkage to the floating element while constraining movement in two directions such as fore/aft and left/right. To this end, the capture assembly 330 includes a guide element 332 made up of a connector or mounting member 334 adapted for rigidly affixing the guide element 332 to a track structure (e.g., a portion of the track that is used to move the floating element 320 within a body of water in a controlled and predictable manner). The guide element 332 includes a rigid extension or pivot arm 336 that is rigidly attached at a first end 337 to the connector 334 and has a free second end 338 a distance, $L_{Arm}$, away from the connector 334. The length, $L_{Arm}$, of the arm 336 defines a location of a pivot point for the body 322 relative to the connector 334 and a bogie to which it is attached.

The capture assembly 330 further includes a well or receiver 350 including a body or sidewall 352 defining a cylindrical opening or recessed surface 354. The recessed surface 354 may have a depth or cavity height, $H_{Cavity}$, that is typically more than an expected up and down travel for the body 322 during operation of the ride system 300 to ensure the body 322 remains "captured" by the capture assembly 330. The cavity or well 354 also has an inner diameter, $ID_{Cavity}$, that is typically selected to be nominally the same or slightly larger than a received end 340 of the guide element 332.

In this regard, the guide element 332 includes a head or pivotal structure 340 affixed rigidly to the end 338 of the pivot arm 336. The head 340 provides a contact or pivot surface 342 that mates with portions of the inner surfaces of the sidewall/body 352 in cavity/opening 354 during movement of the body 322 in a body of water. The head 340 may be spherical, a partial sphere, or a circular disk/plate as shown and have an outer diameter, $OD_{Head}$, that is generally a small amount smaller than the inner diameter, $ID_{Cavity}$, such that it may move up and down in cavity 354 but be constrained from fore/aft and left/right movement. As shown, the pivot arm 336 has a length, $L_{Arm}$, and this is chosen, typically, to be large enough to avoid contact between the bottom surface 328 and the connector 334 during floating operations, e.g., may be greater than expected up/down travel of the body 322 during operation of ride system 300.

Figure 4A:
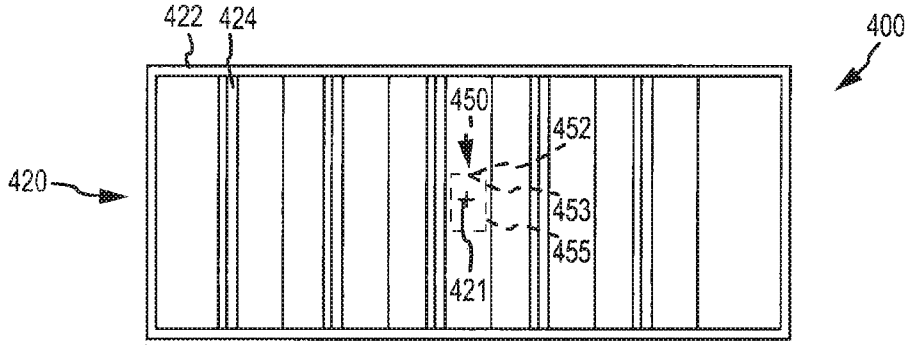
FIGS. 4A and 4B are partial side sectional and top views, respectively, of a boat ride of another embodiment in which the capture assembly is center mounted and has a receiver cavity or well with a rectangular cross-sectional shape.
Figure 4B:
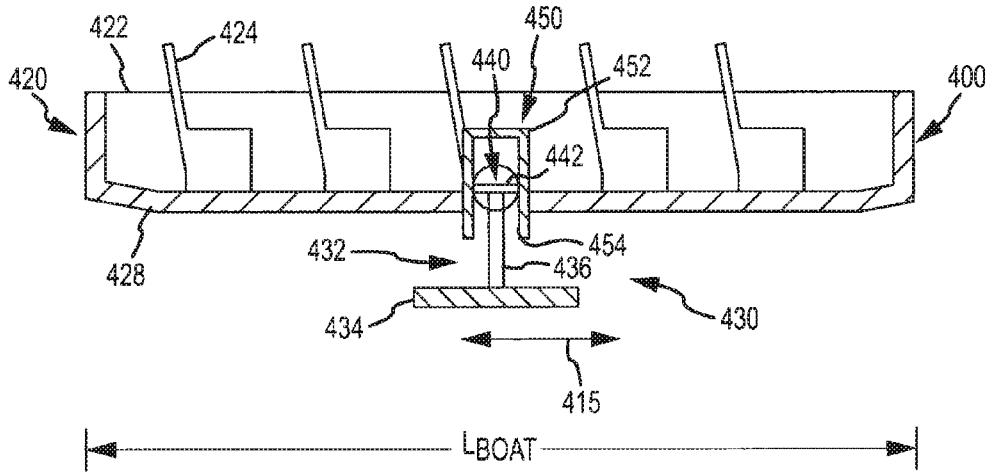

FIGS. 4A and 4B illustrate top and side sectional views, respectively, of another boat ride 400 of the present invention. The ride system 400 may be implemented in a similar manner as that of system 100 such as in a water containment to move boats with a fixed, submerged track system. The ride system 400 includes a boat 420 with a hull 422 that includes a number of benches/seats 424 for passengers and a center of gravity (or flotation) 421 that may be about in the center of the hull/body 422. The hull 422 includes a bottom surface 428 that adapted to allow the boat 420 to float in water or be buoyant, and the hull 422 may be circular or elongated as shown with a length, $L_{Boat}$. In this embodiment, the receiver cavity 450 of the capture assembly 430 is provided to coincide with the center of gravity 421 (e.g., to be about midway along the length, $L_{Boat}$), which may be desirable in some cases to provide the pivot point at about the center of gravity of a floating object (such as a circular raft or similar floating structure).

The ride system 400 includes a capture assembly 430 that may be considered a double-cylinder pivot embodiment. This embodiment acts to provide motion constraint including fore/aft and left/right motion of the hull 422 about a pivot point (e.g., provided at head/pivot structure 440), but the embodiment also constrains yaw movement in contrast to the embodiments in boat rides 100 and 300. The embodiment then allows free movements in the forms of up/down (vertical), roll, and pitch movements of the hull 420 relative to the pivot point/capture location.

To this end, the capture assembly 430 includes a guide element 432 with a mounting element 434 that would be attached to a track structure to provide controlled movement 415 of the guide element 432. The guide element 432 includes an elongated and rigid extension/pivot arm 436 extending outward from the base 434. The capture assembly 430 includes a receiver cavity or well 450 made up a sidewall/body 452 extending outward from (or flush with) the bottom surface 428 of the hull 422. The cavity sidewall 452 defines cavity or opening 454 to provide an access to the receiver cavity 450 at the bottom surface 428. Further, in the capture assembly 430, the guide element 432 includes a pivot structure or head 440 rigidly attached to an end of the extension arm 436, and, during use or capture, the head 440 is positioned or received within the cavity/opening 454 defined by sidewall(s) 452.

As shown, the cross sectional shape of the cavity/well 454 is generally rectangular (e.g., is a double-wall cavity), and the head 440 may be a rectangular plate or, more preferably, may be a double cylinder. In this regard, a "double" cylinder is a cylinder (which may be arranged with its longitudinal axis orthogonal to the longitudinal axis of the extension arm) that has its edges curved or smoothed. In other words, it may be formed by first forming a conventional cylinder and then performing a second circular cut orthogonal to the first cylinder's longitudinal axis so as to remove right-angle corners and replace these with arcuate edges on both ends of the cylinder. This may be useful in some embodiments to provide a more desirable pivot surface 442 when the head 440 is received in a well 454 with sidewalls 452 providing a rectangular cross sectional shape.

In use, the double-cylindrical section head 442 is useful for constraining (or providing rigid control over) fore/aft, left/right, and yaw movement while leaving up/down, roll, and pitch movements or free within the receiver cavity or well 450. If the head 442 were a simple cylindrical shape (with flat ends of the cylindrical section not contacting the cavity walls), constraint would be provided fore/aft and left/right while free movement is allowed in other directions/axes (which may be useful to provide a larger contact area than a spherical shaped head). Typically, the cylindrical or double cylindrical section heads will have their long axis arranged to be transverse to the direct of travel or longitudinal axis of the boat as shown in FIG. 4A. In other embodiments, the cross sectional shape of the cavity may also be varied such as to provide an elongated cavity (e.g., not circular in shape) and the ends may be square or semi-circular in shape. Such an elongated cavity may be useful to constrain movement in one direction such as left/right (along the short axis) while allowing more movement in a second, normally constrained direction such as fore/aft.

Figure 5A:
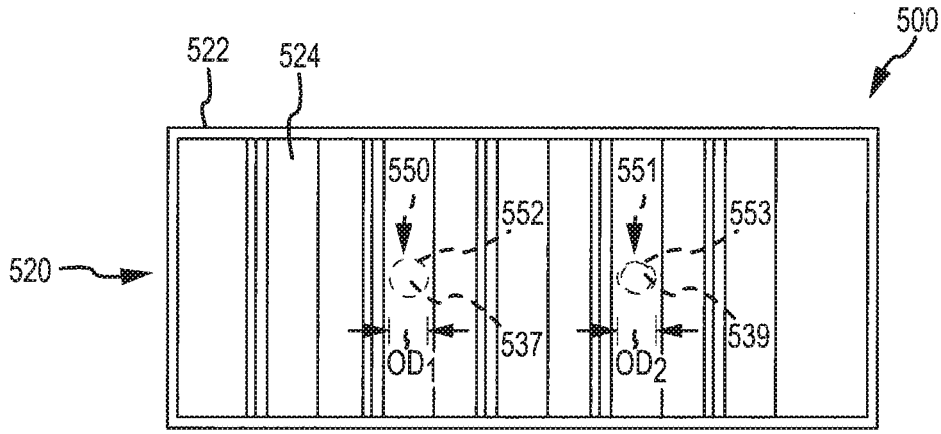
FIGS. 5A and 5B are partial side sectional and top views, respectively, of a boat ride of another embodiment in which the capture assembly providing dual pivot points for a boat.
Figure 5B:
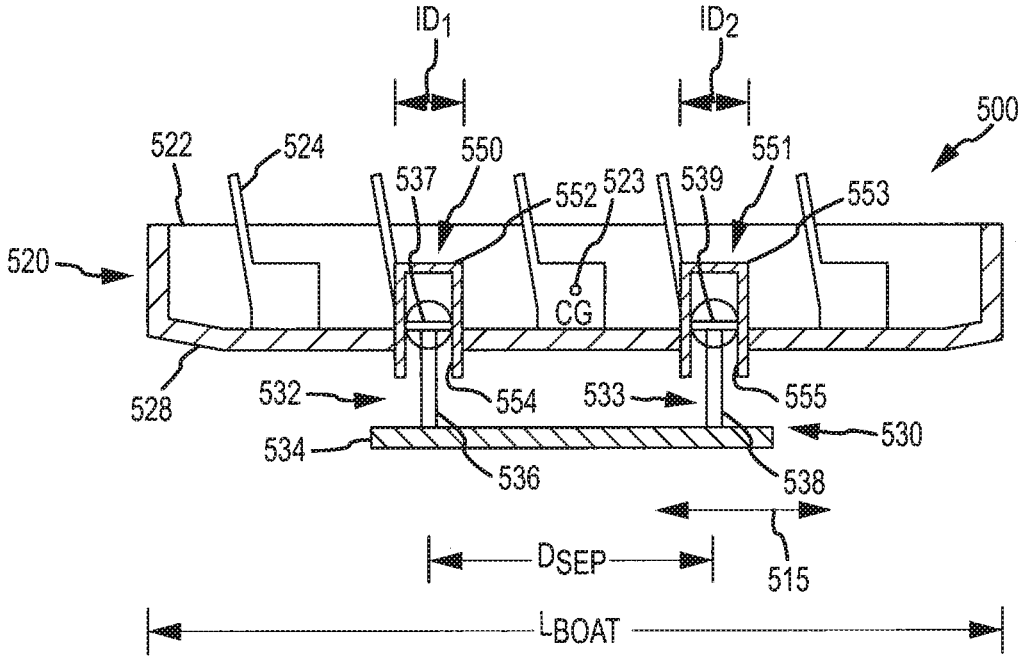

FIGS. 5A and 5B illustrate top and side sectional views, respectively, of yet another embodiment of a boat ride 500 of the present invention. The ride 500 may be thought of as an implementation of a dual pivots (or dual pivot points) embodiment. Dual pivot embodiments may be desirable to provide constraint of fore/aft and left/right motion of pivot points as well as yaw control while providing free movement of the boat in the vertical direction (up/down) as well as roll and pitch movements.

Generally, the dual pivot ride 500 has a main pivot point (shown here at as a rear or aft location) that is a fixed spherical structure or head captured by a cylindrical receiver cavity (e.g., a well with a circular cross sectional shape) on the floating element or boat. Also, a secondary pivot point (shown here as in a forward or fore location) that is a fixed spherical or cylindrical structure or head captured by an elongated receiver cavity (e.g., a well or recessed surface with a cross sectional shape taking the form of a rectangle with semi-circle ends with its longitudinal axis aligned with the longitudinal axis of the boat or floating structure) on the floating element or boat. Note that the placement of the pivot points is relatively arbitrary (or non-limiting to the invention). For example, placement of the main pivot at the center of the floating element (instead of somewhat aft as shown) can reduce the receiver depth needed or found desirable. Also, FIG. 5 shows a fore/aft relationship between the dual pivot points, but, in some embodiments, a left/right or even diagonal relationship between the pivots may work well and be more useful to achieve some desired effect or control over the floating element or boat in the ride 500.

As shown, the boat ride 500 includes a boat 520 with a hull 522 that includes a number of seats/benches 524 for passengers, and the hull 522 includes a bottom surface designed for floating on water. The hull has a length, $L_{Boat}$, and a center of gravity/floatation 523. The boat ride 500 further includes a capture assembly 530 that includes a first or primary guide element 532 and a second or secondary guide element 533. The capture assembly 530 includes a mounting member or base 534 that would be attached to a track assembly to move 515 with a portion of such a track assembly such as to a tracked bogie/vehicle (not shown in FIG. 5). The guide elements 532, 533 each include rigid extension or pivot arms 536, 538 extending up from the mounting member 534 and a head/pivot structure 537, 539 affixed to the other ends of the arms 536, 538. Again, the heads 537, 539 may be spherical, semi-spherical, cylindrical, double cylinder shapes, circular or rectangular disks, or other shapes. The arms are separated by some predefined distance, $d_{Sep}$, such as 2 to 5 feet or more, as measured between the longitudinal axes of the arms 536, 538.

The capture assembly 530 further includes first and second (or primary and secondary) receiver cavities or wells 550, 551 in the hull 522. Each cavity 550, 551 is formed with a body or sidewall(s) 552, 553 that defines a cavity or recessed surface with an opening 554, 555 for receiving the head/pivot structures 537, 539. As with the arms 536, 538, the cavities/openings 554, 555 are spaced apart, e.g., aft and fore along the boat hull 522 such as along a central longitudinal axis passing through the center of gravity 523.

In the primary pivot, the head/pivot structure 537 may be configured to have an outer diameter, $OD_1$, that is about the same as the inner diameter, $ID_1$, of the primary receiver cavity 550. However, to provide the secondary pivot, the head/pivot structure 539 may be configured to have an outer diameter, $OD_2$, that is about the same as the short axis dimension (width of the cylindrical portion) but less than the inner diameter or length of the secondary receiver cavity 551 (as measured along the longitudinal axis of the long axis). In this way, the left/right movement is controlled at both pivot points while the primary pivot point is used to restrain fore/aft movement of the hull 522. The larger $ID_2$ or smaller $OD_2$ is useful for limiting binding during movements of the hull 522.

Figure 6:
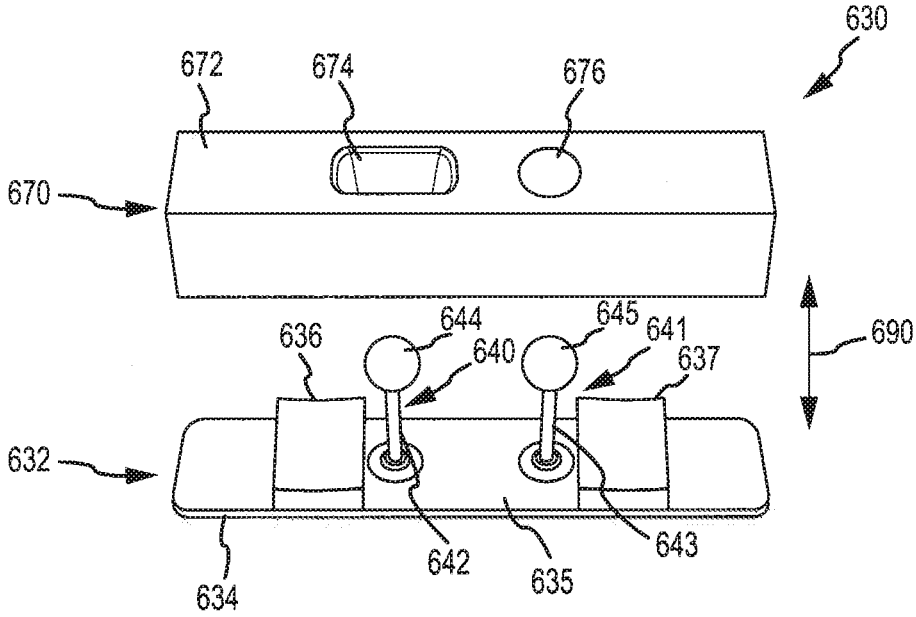
FIG. 6 is an exploded view of a capture assembly of a dual pivot embodiment such as may be used in the boat ride of FIGS. 5A and 5B.

FIGS. 7A-7E illustrate various movements and positions of the boat 520 relative to the capture assembly 530, but, prior to describing these figures and ride operations, it may be useful to describe a capture assembly in more detail that may be used to implement the capture assembly 530. FIG. 6 illustrates an exemplary boat capture assembly 630. The assembly 630 includes a guide element 632 and a floating element portion 670, and, in practice, the guide element 632 would be attached, via base/mounting member 634 to a bogie/vehicle or other motive component of a track assembly while the floating element portion 670 would be mounted upon the bottom of a boat hull or provided as an integral portion of the hull's bottom surface.

The guide element 632 includes a pair of bumpers or stops 636, 637 on an upper surface 635 of the mounting plate 634 that may be provided to provide resting or supporting surfaces for the floating element portion 670. This may be useful in portions of a water ride where the water becomes too shallow to float the boat or when it is desired to provide a more dry-land or amphibious type ride experience. When the portions 670 and an attached boat are on the stops 636, 637, the mounting element 632 and the bogie/vehicle upon which it is mounted act to fully or partially support the boat rather than it being supported by water.

The guide element 632 further includes a primary guide 641 and a secondary guide 640. These guides 640, 641 include extension arms 642, 643 that extend outward at right angles from the upper surface 635 of the mounting plate 634 and are typically rigid (e.g., a solid or hollow metal rod or the like). The guides 640, 641 further includes heads or pivot structures 644, 645 with a larger size or diameter than the arms 642, 643, and, as shown, the heads 644, 645 may be spherical or ball shaped.

The capture assembly 630 further includes a primary well/cavity 676 in floating element portion 670 for receiving the head 645 of the primary guide 641 when the two parts 632, 670 are mated together or assembly as shown with arrow 690 (which also indicates that in use the floating portion 670 may float off of and sink back down toward the plate 634 and stops 636, 637). The capture assembly 630 also includes a secondary well/cavity 674 for receiving the head 944 of the secondary guide 640. As shown, the heads 644, 645 are the same or about the same size as each other (although this is not required). The primary well 676 is cylindrical (or has a circular cross section) with an inner diameter only slightly larger than the outer diameter of the head/pivot structure 645. In contrast, the secondary well 674 is an elongated slot that is generally rectangular in shape with a width only slightly larger than the head 649 to provide tight left/right movement constraint. The slot or well 674 is, however, longer than the outer diameter of the head 644 to limit binding during relative movement of the floating element portion 670, and the well 674 may have semi-circularly end for receiving the curved surfaces of the head 644.

Figure 7A:
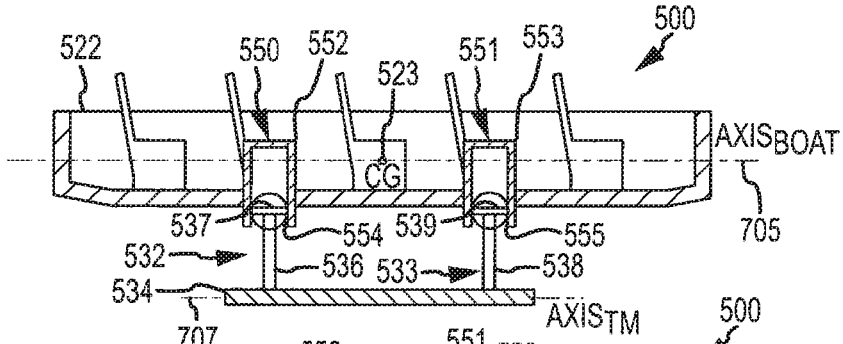
FIGS. 7A-7E are side sectional views of the boat ride of FIG. 5A showing a typical range of free motion relative to the fixed capture mechanism.

FIGS. 7A-7E illustrate the ride system 500 during use showing a number of exemplary boat positions achievable through use of the dual-pivot boat capture assembly 530. In FIG. 7A, the hull 522 is shown to be floating a distance above the mounting member or plate 534 (e.g., above the track structure). The guide elements 532, 533 are shown to have the hull 522 with the heads/pivot structures 537, 539 received or positioned a distance (e.g., at least a few inches) within the cavities/recessed surfaces 554, 555. This hull position may occur, for example, when the boat 520 is being moved through a flat section of track and in relatively still water (so not bobbing up and down), and the axis 705 of the boat is substantially or actually parallel to the axis/plane of the mounting plate/connector 534.

Figure 7B:
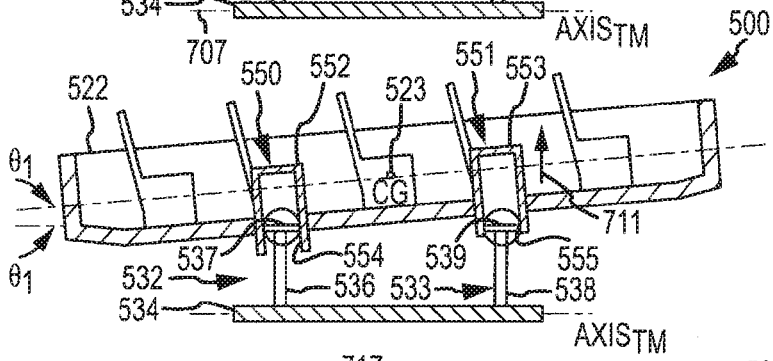

During the operations shown in FIG. 7B, the front end of the hull 522 has risen as shown with arrow 711 such that the hull 522 may be at a negative pitch, $\theta_1$ (as measured from the hull longitudinal axis to horizontal), e.g., −5 degrees or more. The depth is unchanged as measured at the center of gravity 523. Such hull movement may occur, for example, when the mounting plate 534 is moved down an incline. As shown, the hull 522 is able to pivot concurrently at both the primary and secondary pivots provided by contact between head 537 and cavity 554 (or sidewall 552) and between head 539 and cavity 555 (or sidewall 553 or the spacing may be such that little contact occurs in the secondary pivot).

Figure 7C:
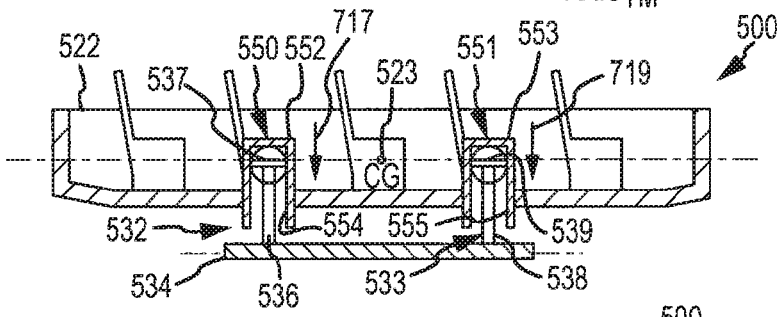

In FIG. 7C, the pitch has returned to zero (e.g., the boat and plate axes 705, 707 are again substantially or actually parallel), and depth (or relative depth) is now negative (e.g., the hull 522 has sunk or bobbed downward a distance as shown with arrows 717, 719), e.g., 0 to 12 inches or more depth/downward movement. This may occur at various points in a ride such as during initial loading of the boat or after moving down/landing after a steep incline and the like. Due to the design of the capture assembly 530, the hull 522 is able to move downward 717, 719 relative to the heads 537, 539 (or capture assembly pivot or capture points) at both wells/cavities 550, 551 (both primary and secondary pivots).

Figure 7D:
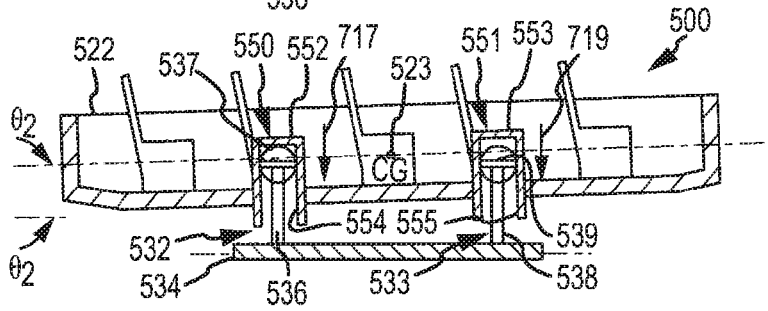
Figure 7E:
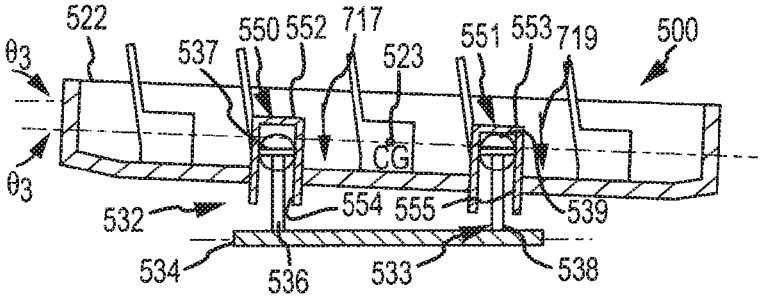

During the ride 500 operations shown in FIG. 7D, the depth is retained but the pitch, $\theta_2$, has again become negative. This may occur when a loaded boat 520 (or a boat bobbing up and down for other reasons) begins to move down an incline as it is pulled/pushed by a bogie to which the plate 534 is attached. Further, sinking may be halted or restrained when a head (such as the primary head 537) contacts a top or upper end/surface of the well (such as top of the primary well/cavity 554 or its sidewall 552). In FIG. 7E, the hull 522 is shown at the same depth but the front end has rocked downward. This may occur when the mounting plate 534 has begun to move up an incline (or if weight is added to the front portion of the boat 520), and the pitch, $\theta_3$, has become positive (e.g., 0 to 5 degrees or more). The pivoting is facilitated by the dual-pivot capture assembly 530 which constrains left/right and fore/aft movement but allows the forward or positive pitch rotation about both the primary and secondary guide elements 532, 533 and the heads/pivot structures 537, 539 positioned in wells/cavities 550, 551.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

The described boat capture assembly and techniques provides a number of useful advantages over other boat tethering devices. The capture assembly has fewer and simpler parts than prior solutions. The capture assembly has no moving or flexible parts in the water, and, as a result, nothing moves within the assembly except the floating element or boat itself (which causes relative movement between the receiver cavity/well and the guide element or at least its end/head, which provides a pivot/contact surface). The roll axis is located in or at the floating element or boat rather than at the bogie structure. The floating element can be easily engaged or disengaged, which simplifies maintenance and facilitates unique show experiences (e.g., can rest on stops/bearing surfaces when not floating for a dry track section of a ride). The capture assembly presents a smaller "footprint" on the boat hull so as to provide more room or space for other equipment that may need to interface with or be provided upon the floating element or boat hull (such as at a station or load/unload portion of a ride). The capture assembly is also useful in relatively shallow depths of water.

I claim:

1. A boat capture assembly for providing enhanced control for boats moved by a track assembly through a body of water, comprising:

a mounting plate attached to a positionable portion of the track assembly;

a rigid extension arm with a first end attached to the mounting plate;

a pivot structure, defining a pivot surface, rigidly attached to a second end of the rigid extension arm; and a receiver cavity provided in a bottom surface of a hull of one of the boats, the receiver cavity comprising a sidewall with an opening receiving the pivot structure and the opening defining a well with a cross sectional size greater than an external size of the pivot structure, wherein the hull is not captured in the vertical direction by the pivot structure such that the receiver cavity may move in the vertical direction relative to the pivot structure and the rigid extension arm.

2. The assembly of claim 1, wherein the well has a depth greater than a predefined vertical travel of the hull of the boat in the body of water.

3. The assembly of claim 2, wherein the depth is greater than about 2 feet.

4. The assembly of claim 1, wherein the well has a circular cross sectional shape with an inner diameter exceeding an outer diameter of the pivot structure.

5. The assembly of claim 4, wherein the inner diameter is less than 1 inch greater than the outer diameter.

6. The assembly of claim 1, wherein the well has a rectangular cross sectional shape, wherein the pivot structure comprises a cylindrical body, and wherein the well has a longer axis transverse to the longitudinal axis of the hull.

7. A boat capture assembly for providing enhanced control for boats moved by a track assembly through a body of water, comprising:

a mounting plate attached to a positionable portion of the track assembly;

a rigid extension arm with a first end attached to the mounting plate;

a pivot structure, defining a pivot surface, rigidly attached to a second end of the rigid extension arm; and a receiver cavity provided in a bottom surface of a hull of one of the boats, the receiver cavity comprising a sidewall with an opening receiving the pivot structure and the opening defining a well with a cross sectional size greater than an external size of the pivot structure, wherein the well has an elongate cross sectional shape with a short axis transverse to the longitudinal axis of the hull and wherein the external size of the pivot structure is about equal to a width of the well measured along the short axis, whereby left to right movement of the hull is restrained.

8. A boat capture assembly for providing enhanced control for boats moved by a track assembly through a body of water, comprising:

a mounting plate attached to a positionable portion of the track assembly;

a rigid extension arm with a first end attached to the mounting plate;

a pivot structure, defining a pivot surface, rigidly attached to a second end of the rigid extension arm;

a receiver cavity provided in a bottom surface of a hull of one of the boats, the receiver cavity comprising a sidewall with an opening receiving the pivot structure and the opening defining a well with a cross sectional size greater than an external size of the pivot structure;

a second rigid extension arm with a first end attached to the mounting plate at a location spaced apart from the rigid extension arm;

a second pivot structure, defining a pivot surface, rigidly attached to a second end of the second rigid extension arm; and a second receiver cavity provided in the bottom surface of the hull, the receiver cavity comprising a sidewall with an opening receiving the pivot structure and the opening defining a well with a cross sectional size greater than an external size of the second pivot structure.

9. A water ride with precise position control, comprising:

a structural containment for receiving a volume of water;

a track assembly positioned within the structural containment to be submerged when the water is received, the track assembly include a bogie selectively positionable upon a length of track;

a boat with a hull with a bottom surface adapted for floating on water; and a capture assembly comprising:

a guide element mounted on the bogie, the guide element including a rigid arm extending out from the bogie and a head provided on the end of the rigid arm; and a receiver cavity extending a depth into the bottom surface of the hull, the head of the guide element being positioned a distance into the receiver cavity, wherein the head of the guide element, when the boat is floating in the water, moves up and down in the receiver cavity and wherein the distance is greater than a predefined maximum vertical excursion of the hull in the water.

10. The water ride of claim 9, wherein the receiver cavity has a circular cross sectional shape and the head has a circular cross section and wherein the receiver cavity has an inner diameter greater than the outer diameter of the head, whereby the head is positionable along at least a portion of the depth of the receiver cavity to allow the hull to move vertically on the guide element.

11. The water ride of claim 10, wherein the head is spherical or semispherical in shape.

12. A water ride with precise position control, comprising:

a structural containment for receiving a volume of water;

a track assembly positioned within the structural containment to be submerged when the water is received, the track assembly include a bogie selectively positionable upon a length of track;

a boat with a hull with a bottom surface adapted for floating on water; and a capture assembly comprising:

a guide element mounted on the bogie, the guide element including a rigid arm extending out from the bogie and a head provided on the end of the rigid arm; and a receiver cavity extending a depth into the bottom surface of the hull, the head of the guide element being positioned a distance into the receiver cavity, wherein the receiver cavity has a rectangular cross sectional shape with long axis orthogonal to the longitudinal axis of the hull and wherein the head has a cylindrical shape with a length about the cross sectional length of the receiver cavity measured along the long axis, whereby left to right movement of the hull relative to the head is restrained.

13. A water ride with precise position control, comprising:

a structural containment for receiving a volume of water;

a track assembly positioned within the structural containment to be submerged when the water is received, the track assembly include a bogie selectively positionable upon a length of track;

a boat with a hull with a bottom surface adapted for floating on water; and a capture assembly comprising:

a guide element mounted on the bogie, the guide element including a rigid arm extending out from the bogie and a head provided on the end of the rigid arm;

a receiver cavity extending a depth into the bottom surface of the hull, the head of the guide element being positioned a distance into the receiver cavity;

a second guide element mounted on the bogie, the second guide element including a second rigid arm extending out from the bogie and a second head provided on the end of the second rigid arm; and a second receiver cavity, spaced apart from the receiver cavity, extending a depth into the bottom surface of the hull, the second head of the second guide element being positioned a distance into the second receiver cavity.

14. The water ride of claim 13, wherein the head has an outer diameter of about an inner diameter of the receiver cavity and the second head has an outer diameter less than in inner diameter of the second receiver cavity by at least about 3 inches.

15. A dual-pivot boat capture assembly for providing enhanced control for a boat moved through water by a track assembly, comprising:

a primary receiver cavity extending a depth into a bottom surface of the boat;

a primary guide element with a rigid extension arm extending up from a first end attached to the track assembly to a second end and with a pivot structure affixed to the second end, the pivot structure of the primary guide element positioned within the primary receiver cavity;

a secondary receiver cavity extending a depth into the bottom surface of the boat; and a secondary guide element with a rigid extension arm extending up from a first end attached to the track assembly to a second end and with a pivot structure affixed to the second end, the pivot structure of the secondary guide element positioned within the secondary receiver cavity wherein the secondary receiver cavity has an elongated cross section with a short axis transverse to a longitudinal axis of the boat, wherein the pivot structure of the secondary guide element has an outer dimension substantially equal to the width of the secondary receiver cavity as measured along the short axis, wherein the pivot structure of the secondary guide element has a circular cross section with an outer diameter less than the width by less than about 1 inch, whereby movement transverse to the longitudinal axis of the boat is constrained, and wherein the secondary receiver cavity has a length as measured along a long axis parallel to the longitudinal axis of the boat that is greater than the outer diameter of the secondary guide element by at least about 3 inches, whereby by binding during pitching of the boat is controlled.

16. The assembly of claim 15, wherein the depths of the primary and secondary receiver cavity are at least about twice a predefined vertical travel of the bottom surface of the boat relative to a surface of the water.

17. The assembly of claim 15, wherein the primary receiver cavity has a circular cross sectional shape and wherein the pivot structure of the primary guide element has a circular cross section with a maximum outer diameter less than an inner diameter of the primary receiver cavity, whereby the primary guide element can move relative to the primary receiver cavity in a vertical direction relative to the track assembly.

* * * * *